US010305174B2

(12) United States Patent
Ryan et al.

(10) Patent No.: US 10,305,174 B2
(45) Date of Patent: May 28, 2019

(54) DUAL-POLARIZED, OMNI-DIRECTIONAL, AND HIGH-EFFICIENCY WEARABLE ANTENNA ARRAY

(71) Applicant: Futurewei Technologies, Inc., Plano, TX (US)

(72) Inventors: Colan Graeme Matthew Ryan, San Diego, CA (US); Hungyu David Yang, Darien, IL (US)

(73) Assignee: Futurewei Technologies, Inc., Plano, TX (US)

( * ) Notice: Subject to any disclaimer, the term of this patent is extended or adjusted under 35 U.S.C. 154(b) by 88 days.

(21) Appl. No.: 15/480,136

(22) Filed: Apr. 5, 2017

(65) Prior Publication Data

US 2018/0294551 A1 Oct. 11, 2018

(51) Int. Cl.

| | |
|---|---|
| ***H01Q 1/27*** | (2006.01) |
| ***H01Q 9/32*** | (2006.01) |
| ***H01Q 21/20*** | (2006.01) |
| ***H01Q 21/24*** | (2006.01) |
| ***H01Q 21/28*** | (2006.01) |

(52) U.S. Cl.

CPC ..... *H01Q 1/273* (2013.01); *H01Q 9/32* (2013.01); *H01Q 21/205* (2013.01); *H01Q 21/24* (2013.01); *H01Q 21/28* (2013.01)

(58) Field of Classification Search

CPC ..... H01Q 1/38; H01Q 21/22; H01Q 21/0031; H01Q 1/48

USPC ..... 343/718

See application file for complete search history.

(56) References Cited

U.S. PATENT DOCUMENTS

| | | | | |
|---|---|---|---|---|
| 3,977,003 | A | 8/1976 | Kershaw | |
| 5,886,667 | A | 3/1999 | Bondyopadhayay | |
| 6,995,723 | B1 | 2/2006 | Adams | |
| 7,586,463 | B1 | 9/2009 | Katz | |
| 7,750,860 | B2 | 7/2010 | Mohamadi | |
| 8,203,497 | B2 | 6/2012 | Sabban | |
| 8,667,617 | B2 | 3/2014 | Glezerman et al. | |
| 8,833,665 | B2 | 9/2014 | Grange et al. | |
| 9,413,060 | B2 | 8/2016 | Wong et al. | |
| 9,437,929 | B2 * | 9/2016 | Isom | H01Q 9/0407 |
| 9,680,234 | B2 * | 6/2017 | Love | H01Q 25/001 |

(Continued)

OTHER PUBLICATIONS

Abbasi et al., "A high gain EBG backed monopole for MBAN off-body communication," 2016 IEEE International Symposium on Antennas and Propagation (APSURSI), IEEE, 2016, pp. 1907-1908.

*Primary Examiner* — Brian K Young

(74) *Attorney, Agent, or Firm* — Garlick & Markison; Bruce Garlic

(57) ABSTRACT

An antenna array and a system including the antenna array are provided for implementing wireless communication in a wearable device. The antenna array includes a first plurality of antennas integrated with an antenna substrate and a second plurality of antennas integrated with the antenna substrate. Each antenna in the first plurality of antennas is disposed perpendicular to a ground plane, and each antenna in the second plurality of antennas is disposed parallel to the ground plane. The first plurality of antennas and the second plurality of antennas generate omni-directional electro-magnetic (EM) radiation in at least two different polarizations, which makes the antenna array suitable for wearable applications.

27 Claims, 7 Drawing Sheets

(56) References Cited

U.S. PATENT DOCUMENTS 9,711,865 B2 * 7/2017 Liu ..... H01Q 15/242
9,799,963 B2 * 10/2017 Huang ..... H01Q 21/26

* cited by examiner

DUAL-POLARIZED, OMNI-DIRECTIONAL, AND HIGH-EFFICIENCY WEARABLE ANTENNA ARRAY

FIELD OF THE INVENTION

The present invention relates to radio frequency wireless communications, and more particularly to a wearable antenna array.

BACKGROUND

Wireless communications are pervasive in today's consumer electronics. Cellular phones, Bluetooth® devices, and wireless streaming video are all common applications that rely on wireless signals to transfer data. Users walk around constantly in communication with one another via one device or another. The field of body-wearable antennas allow user to interact with wireless terminals hands free by incorporating the antenna within, or placed upon, an article of clothing worn by the user. Antennas may be sewn into jackets or sweatshirts, or placed in a helmet or other wearable device, and enable a consumer electronic device to communicate via the antenna.

However, such antennas have a few challenges to overcome. First, any antenna system must overcome the Ohmic losses incurred by a propagating electromagnetic wave in the vicinity of a human body (i.e., where energy from the antenna is not radiated to the intended receiver but is instead absorbed as heat by the body). Second, the antenna's form factor must be small enough to ensure the user's comfort. Small antennas are inefficient radiators, and, consequently, the effective range of the antenna system is reduced as the form factor of the antenna system is shrunk. Third, the location and orientation of the antenna will be constantly shifting as the user moves. Consequently, unidirectional and single polarity antennas are not suitable for such an application as signal strength will vary with orientation to the wireless terminal. Therefore, an antenna system that can overcome these challenges is desired.

SUMMARY

An antenna array and a system including the antenna array are provided for implementing wireless communication in a wearable device. The antenna array includes a first plurality of antennas integrated with an antenna substrate and a second plurality of antennas integrated with the antenna substrate. Each antenna in the first plurality of antennas is disposed perpendicular to a ground plane of the system, and each antenna in the second plurality of antennas is disposed parallel to the ground plane. Generally, the axial orientation of the first plurality of antennas is orthogonal to the axial orientation of the second plurality of antennas. The first plurality of antennas and the second plurality of antennas generate omni-directional electro-magnetic (EM) radiation in at least two different polarizations, which makes the antenna array suitable for wearable applications.

In a first embodiment, each antenna in the first plurality of antennas is a monopole antenna.

In a second embodiment (which may or may not be combined with the first embodiment), the antenna substrate has a cylindrical shape. In addition, the first plurality of antennas and the second plurality of antennas are arranged in a circular pattern proximate an edge at a perimeter of the antenna substrate.

In a third embodiment (which may or may not be combined with the first and/or second embodiments), each antenna in the second plurality of antennas is a loop antenna disposed on a plane of the antenna substrate that is parallel to the ground plane.

In a fourth embodiment (which may or may not be combined with the first, second, and/or third embodiments), a distance between the plane of the antenna substrate and the ground plane is based on a wavelength corresponding to an operating frequency of the antenna array and material characteristics of the antenna substrate. Ideally, the distance is equal to one quarter of the wavelength corresponding to an operating frequency of the antenna array, adjusted according to the material characteristics, such as permittivity, of the antenna substrate.

In a fifth embodiment (which may or may not be combined with the first, second, third, and/or fourth embodiments), the operating frequency of the antenna array is within a 57 GHz to 66 GHz band range.

In a sixth embodiment (which may or may not be combined with the first, second, third, fourth, and/or fifth embodiments), each antenna in the second plurality of antennas is a dipole antenna.

In a seventh embodiment (which may or may not be combined with the first, second, third, fourth, fifth, and/or sixth embodiments), the antenna array further includes a ground wall that comprises a plurality of vias and printed metal layers integrated with the antenna substrate.

In an eighth embodiment (which may or may not be combined with the first, second, third, fourth, fifth, sixth, and/or seventh embodiments), the first set of antennas and the second set of antennas are configured to operate as a phased array.

In a ninth embodiment (which may or may not be combined with the first, second, third, fourth, fifth, sixth, seventh, and/or eighth embodiments), the antenna array is mounted in a wearable device such that a ground plane is disposed between a body of a user and the antenna array.

In a tenth embodiment (which may or may not be combined with the first, second, third, fourth, fifth, sixth, seventh, and/or eighth embodiments), the antenna array is included in a system comprising a printed circuit board (PCB) substrate, a system-on-chip (SoC) mounted to a first side of the PCB substrate, and the antenna array mounted to a second side of the PCB substrate opposite the first side of the PCB substrate.

To this end, in some optional embodiments, one or more of the foregoing features of the aforementioned apparatus and/or system may afford an omni-directional, multiple polarization wearable antenna array that, in turn, may enable better wireless communications between a wearable device and a remote transceiver. It should be noted that the aforementioned potential advantages are set forth for illustrative purposes only and should not be construed as limiting in any manner.

DETAILED DESCRIPTION

An antenna system is disclosed herein that operates, nominally, near the 60 GHz frequency bands, although the antenna system may be sized for other frequency bands. The 60 GHz frequency band enables the antennas to operate efficiently at sizes of only a few millimeters. This small dimensional characteristic of the antennas enables an antenna array to be designed that fits in a small form factor, which enables the antenna array to be embedded within a large amount of wearable items. The antenna array includes at least two sets of antennas: a first plurality of antennas that generates electro-magnetic (EM) radiation having a first polarization; and a second plurality of antennas that generates EM radiation having a second polarization that is different from the first polarization. A ground plane is also used to shield the antenna array from a user's body. Ideally, the antennas are arranged radially around an axis normal to the ground plane to provide omni-directional radiation at two or more different polarizations. As used herein, the term "radially" refers to the arrangement of the antennas around a common axis, where each antenna is located at a radial distance from the axis and a particular angle from a reference plane. The axis lies in the reference plane. The radial distance and angle may be varied with each antenna such that the antennas are arranged in, e.g., a rectangular or hexagonal pattern, or the radial distance can be constant such that the antennas are arranged in a circular pattern.

Figure 1A:
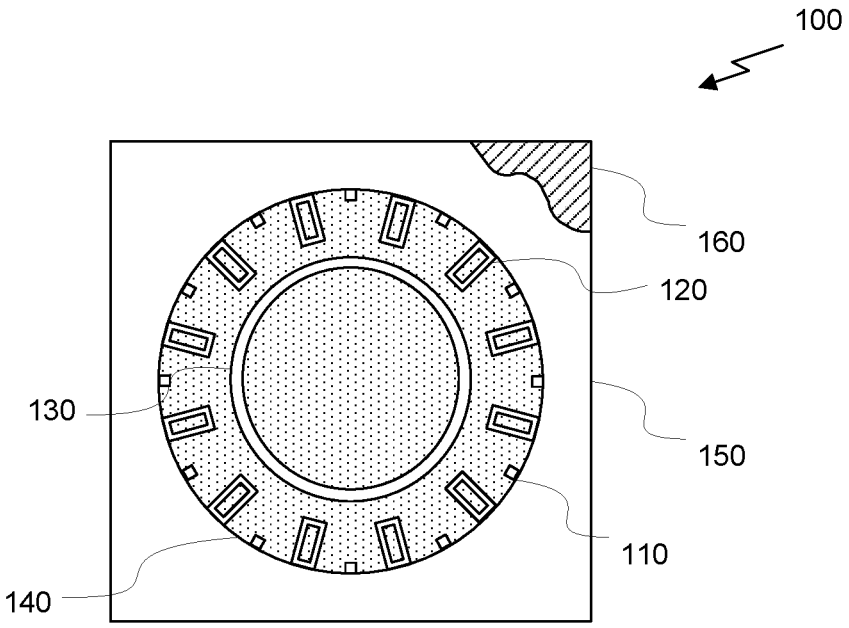
FIGS. 1A & 1B illustrate an antenna array, in accordance with one embodiment.
Figure 1B:
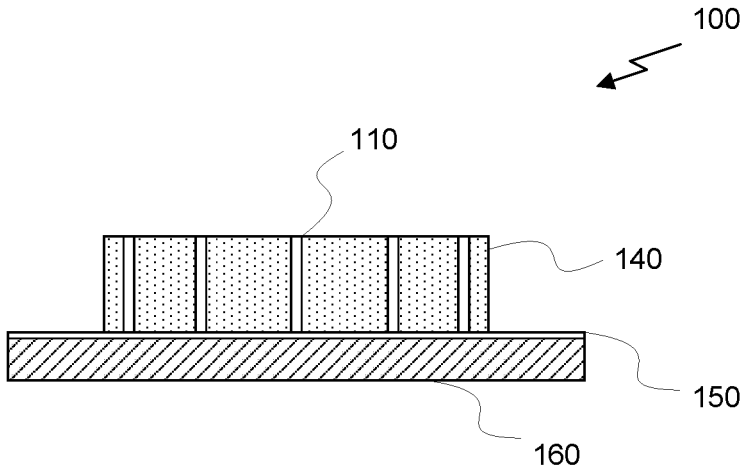

FIGS. 1A & 1B illustrate an antenna array 100, in accordance with one embodiment. FIG. 1A shows a top view of the antenna array 100, and FIG. 1B shows a front view of the antenna array 100. As shown in FIGS. 1A and 1B, the antenna array 100 includes a first plurality of antennas 110 integrated with an antenna substrate 140. In one embodiment, each antenna in the first plurality of antennas is a monopole antenna 110. As used herein, the terms "integrated with" may refer to forming the antennas in the antenna substrate 140, such as by drilling or etching a cavity in the antenna substrate 140 and then plating or filling the cavity with a metal such as copper, or forming the antennas on the antenna substrate 140, such as printing or laminating a metal layer on a surface of the antenna substrate 140.

In one embodiment, the antenna substrate 140 is a dielectric material such as a ceramic or glass composite material. The antenna substrate 140 has a cylindrical shape, although other shapes are contemplated within the scope of the present disclosure. Each monopole antenna 110 in the first plurality of antennas is a straight rod of length l oriented perpendicular to a ground plane 150 and disposed proximate an edge at a perimeter (i.e., on the cylindrical surface) of the antenna substrate 140. The plurality of monopole antennas 110 is arranged in a circular pattern. In one embodiment, the monopole antennas 110 and the ground plane 150 are formed from a conductive material such as copper. The cross-sectional shape of each monopole antenna 110 may be circular or rectangular (or any other feasible shape such as hexagonal). The length l of the monopole antennas 110 should be at least one quarter of the wavelength of the operating frequency of the antenna array 100, and should be significantly larger than a diameter d of the rod (i.e., l>>d), where the diameter d refers to the largest measured distance across the cross-sectional shape of the monopole antenna 110.

In one embodiment, the operating frequency of the antenna array is 60 GHz, which corresponds with a wavelength of 5 mm when the EM wave is traveling in a vacuum. Consequently, the length l of each monopole antenna should be approximately 1.25 mm. However, the optimal length l will vary based on the material characteristics (e.g., permittivity $\in$) of the antenna substrate 140 and the operating frequency of the antenna array 100, given that EM waves travel slower than the speed of light in a vacuum c when traveling through a material. It will also be appreciated that the permittivity of a material may vary with the operating frequency of the antenna array 100. Consequently, the length/is dictated by the wavelength of the EM radiation, which is compressed when moving slower through the antenna substrate 140 than the speed of light in a vacuum c. In another embodiment, the operating frequency of the antenna array 100 is within a 57 GHz to 66 GHz band range. It yet another embodiment, the operating frequency of the antenna array 100 may be selected based on a form factor of the antenna array. For example, if an antenna array can be sized to use monopole antennas of 3.75 mm in length, then the operating frequency of the antenna array may be approximately 20 GHz, depending on the material characteristics of the antenna substrate 140. It will be appreciated that the lower limit of operating frequency should be above 2.4 GHz, as the length of the monopole antennas would be a little over 30 mm (or less depending on the material of the antenna substrate 140) and the size of the antenna array 100 at that point would be too bulky to embed within a wearable device without affecting the comfort of the user, although some items, such as helmets, may be able to embed such large antenna arrays without compromising comfort as the device is structurally very stiff and already designed with significant weight.

The antenna array 100 also includes a second plurality of antennas 120 integrated with the antenna substrate 140. The second plurality of antennas 120 are disposed on a plane of the antenna substrate 140 that is parallel to the ground plane 150. The optimal distance between the plane of the antenna substrate 140 and the ground plane 150 is approximately one quarter wavelength of the operating frequency of the antenna array 100, adjusted based on the material characteristics of the antenna substrate 140 and an operating frequency of the antenna array 100. This is because the ground plane 150, in addition to shielding EM radiation from being absorbed by the body as heat, reflects the EM radiation from the loop antennas 120 which produces constructive interference of the signal being transmitted by the antennas 120. A radio frequency (RF) EM wave undergoes a 180 degree phase shift when reflected off the ground plane 150. By adding that phase shift to the distance traveled from the antenna to the ground plane and back, the reflected signal should be approximately in-phase with the signal generated by the antennas 120, retarded by one wavelength. These signals will then interfere constructively to boost the gain of the antennas 120.

In one embodiment, each antenna in the second plurality of antennas 120 is a loop antenna, where the plurality of antennas 120 is arranged in a circular pattern proximate an edge at a perimeter of the antenna substrate 140. In one embodiment, the loop antenna has a circumference approximately equal to one wavelength of the operating frequency of the antenna array 100, which, again, is dependent on material characteristics of the antenna substrate 140 and the operating frequency of the antenna array 100. If the loop is a square, then that means that each side of the loop has a length l, which is the same as the length of the monopole antennas 110. In other embodiments, the shape of the loop antenna may be different, such as a rectangle having a short side and a long side or a circle. Whereas each of the monopole antennas in the plurality of antennas 110 radiates outward from an axis perpendicular to the ground plane 150, each loop antenna in the plurality of antennas 120 will radiate normal to the ground plane along the axis perpendicular to the ground plane 150. In another embodiment, decreasing the size of each loop antenna would result in radiation in the same direction as the monopole antennas, while maintaining the polarization of the original one-wavelength circumference loop.

The antenna array 100 further includes a ground wall 130 coupled to the ground plane 150. The ground wall 130 is implemented as a plurality of vias and printed metal layers integrated with the antenna substrate 140. The plurality of vias may be arranged in a circular pattern, with each via disposed a short distance from at least one other via in the plurality of vias such that the ground wall 130 emulates a solid metal surface. The plurality of vias are coupled together, conductively, via the printed metal layers. In one embodiment, the distance between each via should be small, such as one tenth of the wavelength of the operating frequency of the antenna array 100, in order to emulate a solid ground plane. The ground wall 130 reflects radiation outward to enhance the gain of the first plurality of antennas 110. The distance of the ground wall 130 to the monopole antennas should also be approximately one quarter of the wavelength of the operating frequency of the antenna array 100, which, again, is dependent on material characteristics of the antenna substrate 140 and the operating frequency of the antenna array 100. The arrangement of the ground wall 130 and ground plane 150 directs most of the radiation from the antenna array 100 outwards, radially, and up away from the ground plane 150 in order to provide omni-directional coverage away from the user's body.

In one embodiment, the ground plane 150 is a metal layer, such as copper, formed on the surface of a printed circuit board (PCB) substrate 160. Alternatively, the ground plane 150 may be formed on the bottom surface of the antenna substrate 140. The PCB substrate may be one or more layers of FR-4 glass epoxy (e.g., a fiberglass cloth with epoxy resin composite material) having thin copper foil laminated thereon and etched to form traces. Vias may be drilled or otherwise formed therein to connect multiple layers of the PCB substrate 160 or route signals from one side of the PCB substrate 160 to the other. The ground plane 150 may include voids or holes located under the antenna substrate 140 such that signals routed through the PCB substrate 160 can be connected to the first plurality of antennas 110 and the second plurality of antennas 120.

In one embodiment, the signals for the second plurality of antennas 120 may be routed through the antenna substrate 140 on a trace or via in close proximity to a ground trace or via. Ideally, the ground trace could surround the signal trace or via, thereby confining the electric and magnetic fields from the signal trace between the PCB substrate 160 and the connection to the antenna. The signal trace may be connected to a positive terminal of the loop antenna and the ground trace may be connected to a negative terminal of the loop antenna. Thus, the ground trace and the signal trace have opposing currents that cancel out the EM radiation when routing the signal to the loop antenna. In one embodiment, the signal(s) for the second plurality of antennas 120 may be routed up through the interior of the ground wall 130 to further isolate any EM radiation generated by the signal trace.

It will be appreciated that the number of antennas in the antenna array may vary. For example, the antenna array 100 may include as few as two antennas in each set of antennas (i.e., two monopole antennas 110 and two loop antennas 120). However, the radiation of RF waves is typically more uniform with a larger number of antennas. The number of antennas may be limited by size of the antenna array 100 and/or the number of transceivers and signals used to transmit or receive via the antenna array 100. In one embodiment, one signal may be sent to all antennas in the antenna array 100. However, a single signal may not be optimal as the EM radiation from different antennas will interfere, sometimes constructively and other times destructively. In other embodiments, multiple signals may be transmitted to the antenna array 100. Each signal may be phase shifted to form a beam transmitted in a particular direction. In other words, the antenna array 100 may be configured to operate as a phased array. It will be appreciated that the layout of the antenna array 100, as well as the relative phase of each signal provided to the plurality of antennas 110 and the plurality of antennas 120 in the antenna array 100, will contribute to the amount of constructive and destructive interference at any location of a potential base station communicating with the antenna array 100.

In yet another embodiment, each antenna in the first plurality of antennas 110 may be a dipole antenna rather than a monopole antenna. Each side of the dipole antenna may be of length l, such that the total length of the dipole antenna is of length 2l. It will be appreciated that the type of antennas implemented in the first plurality of antennas 110 disposed in the antenna substrate 140 perpendicular to the ground plane may be other types of antennas as well, such as slot loop antennas. The important difference between the first plurality of antennas 110 and the second plurality of antennas 120 is that the two sets of antennas produce EM radiation that has two or more different polarizations.

Figure 2A:
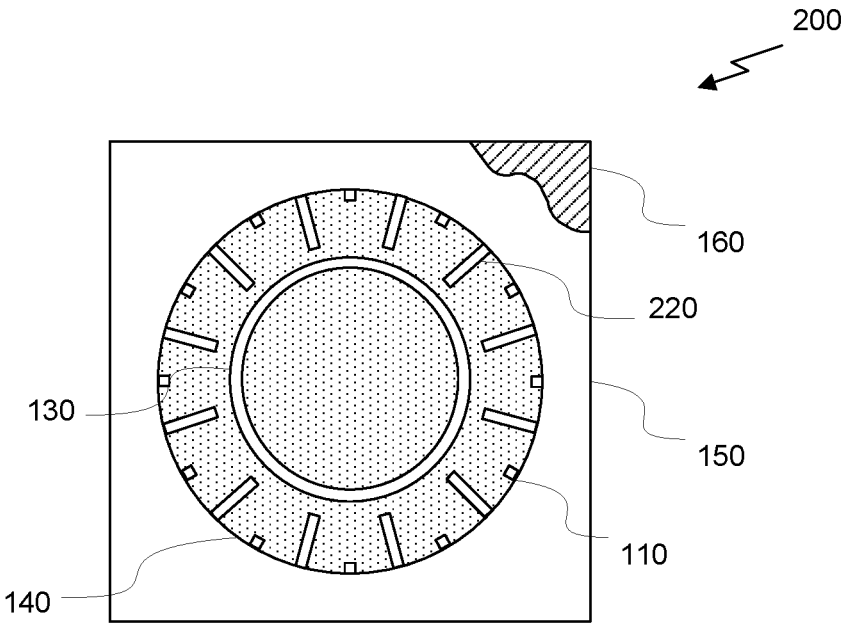
FIGS. 2A & 2B illustrate an antenna array, in accordance with another embodiment.
Figure 2B:
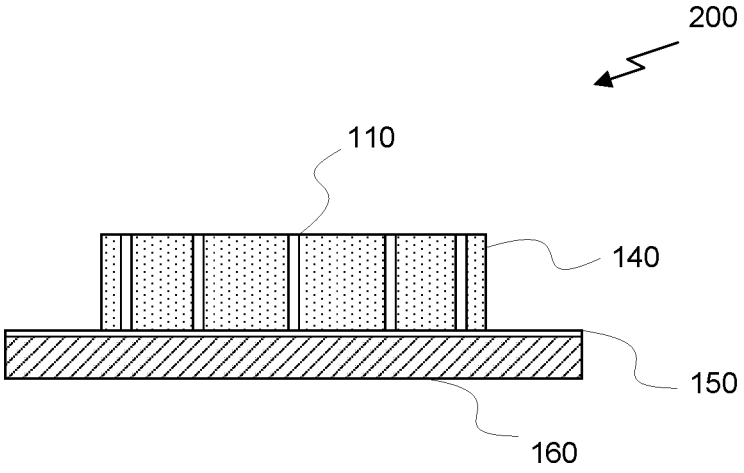

FIGS. 2A & 2B illustrate an antenna array 200, in accordance with another embodiment. FIG. 2A shows a top view of the antenna array 200, and FIG. 2B shows a front view of the antenna array 200. The antenna array 200 is similar to antenna array 100. The antenna array 200 includes a first plurality of antennas 110 integrated with an antenna substrate 140; a second plurality of antennas 220 integrated with the antenna substrate 140 and disposed on a plane of the antenna substrate 140 that is parallel to a ground plane 150; a ground wall 130; and the ground plane 150 formed on a PCB substrate 160. Except as otherwise noted below, operation and composition of the components of antenna array 200 are similar to the operation and composition of similar components of antenna array 100. However, each antenna in the second plurality of antennas 220 is a monopole antenna rather than a loop antenna. Each monopole antenna in the second set of antennas 220 is a straight rod of length l oriented parallel to the ground plane 150. The second plurality of antennas 220 may be arranged in a circular pattern with an orientation of each monopole antenna varying around a z-axis normal to the ground plane and passing through the center of the antenna substrate 140. Each monopole antenna may be connected to ground via the ground wall 130.

Alternately, in another embodiment, each antenna in the second plurality of antennas 220 is a dipole antenna. Each dipole antenna may be a half-wave dipole such that each half of the dipole antenna is a straight rod of length l oriented parallel to a ground plane 150, meaning the total length of the dipole antenna is 2 l. Consequently, the layout of the antenna array 200 may need to be changed because the dipole antennas 220 would interfere with the ground wall 130. In one embodiment, the dipole antennas 220 could be rotated 90 degrees so that instead of aligning with radii of the cylindrical antenna substrate 140, the dipole antennas 220 are oriented orthogonal to the radii of the cylindrical antenna substrate 140. Alternatively, the monopole antennas in the first plurality of antennas 110 could be moved in from the edge of the antenna substrate 140 to a location one quarter of a wavelength of the operating frequency from the edge of the antenna substrate 140. Thus, the dipole antennas 220 could span from the edge of the antenna substrate 140 to the ground wall 130, with the monopole antennas 110 located at a distance halfway there between.

Figure 3A:
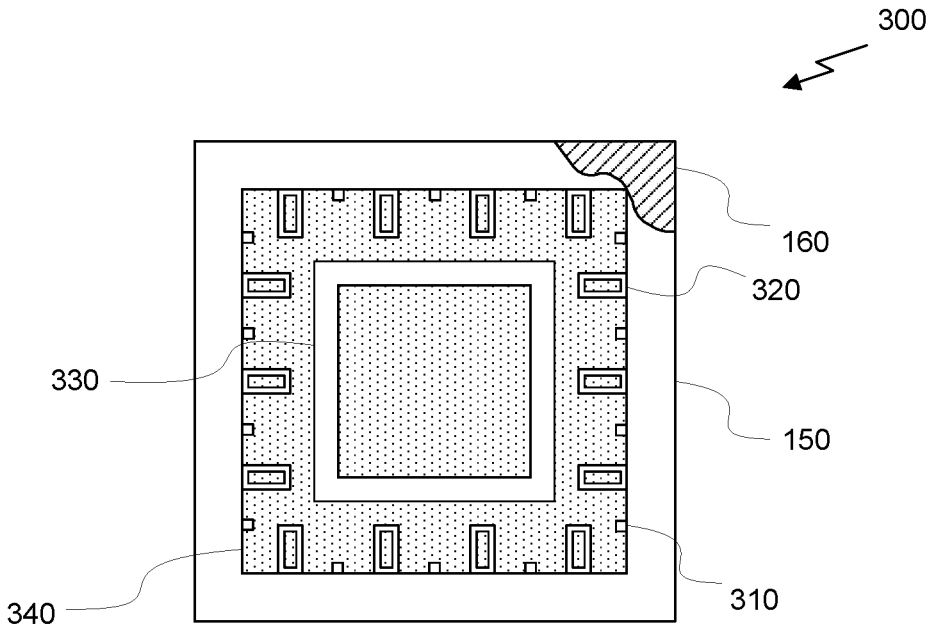
FIGS. 3A & 3B illustrate an antenna array, in accordance with another embodiment.
Figure 3B:
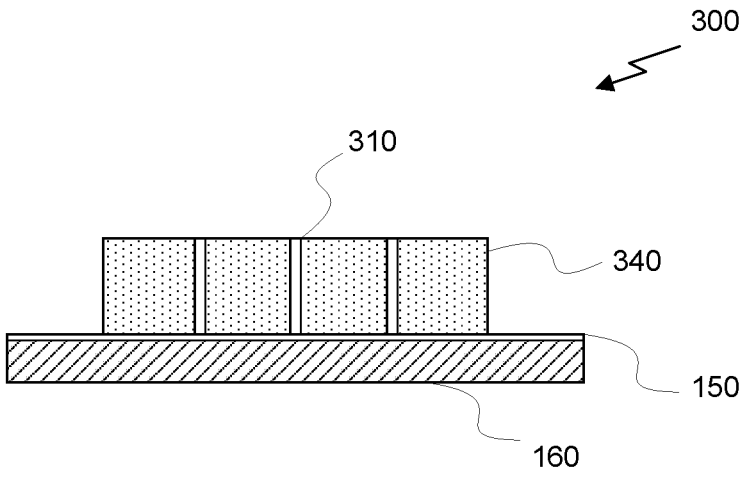

FIGS. 3A & 3B illustrate an antenna array 300, in accordance with another embodiment. FIG. 3A shows a top view of the antenna array 300, and FIG. 3B shows a front view of the antenna array 300. The antenna array 300 is similar to antenna array 100. The antenna array 300 includes a first plurality of antennas 310 integrated with an antenna substrate 340; a second plurality of antennas 320 integrated with the antenna substrate 340, and disposed on a plane of the antenna substrate 340 that is parallel to a ground plane 150; a ground wall 330; the ground plane 150; and a PCB substrate 360. Except as otherwise noted below, operation and composition of the components of antenna array 300 are similar to the operation and composition of similar components of antenna array 100. Antenna substrate 340 is similar to antenna substrate 140 except that the cross-sectional shape of the antenna substrate 340 is rectangular or square instead of cylindrical. In addition, instead of the first plurality of antennas 110 and the second plurality of antennas 120 being arranged in a circular pattern, the first plurality of antennas 310 and the second plurality of antennas 320 are arranged in a rectangular pattern proximate an edge at a perimeter of the antenna substrate 340. The antenna substrate 340 and ground wall 330 are also in a rectangular shape. Each antenna in the first plurality of antennas 310 is a monopole antenna, and each antenna in the second plurality of antennas 320 is a loop antenna, although it will be appreciated that different types of antennas may be substituted therein, in other embodiments.

The ground wall 330 is implemented as a plurality of vias and printed metal layers integrated with the antenna substrate 340. The plurality of vias may be arranged in a rectangular pattern, with each via disposed a short distance from at least one other via in the plurality of vias such that the ground wall 330 emulates a solid metal surface. The plurality of vias are coupled together, conductively, via the printed metal layers It will be appreciated that, in other embodiments, the cross-sectional shape of the antenna substrate 340 and ground wall 330 may be other than rectangular or cylindrical, such as square, hexagonal, or elliptical. Furthermore, the radial arrangement of antennas 310 and/or 320 may match the shape of the antenna substrate 340. More specifically, the first plurality of antennas 310 and the second plurality of antennas 320 are distributed around the perimeter of the antenna substrate 340 in a pattern. In one embodiment, the pattern is uniform (i.e., antennas are evenly distributed) and/or symmetric about a plane cutting through a polar axis of the antenna substrate. Furthermore, the antennas 320 are disposed to be axially orthogonal in relation to a proximate edge (i.e., an axis of the antenna is orthogonal to a tangent of the edge). The axis of a loop antenna may be defined as an axis parallel to the long dimension of the loop passing through the center of the loop. The shape of the antenna substrate 340 and ground wall 330, and consequently the arrangement of antennas, may be selected based on a form factor that works well with the item that the antenna array 300 is to be embedded within, such as a shirt, jacket, helmet, backpack, and the like.

Figure 4A:
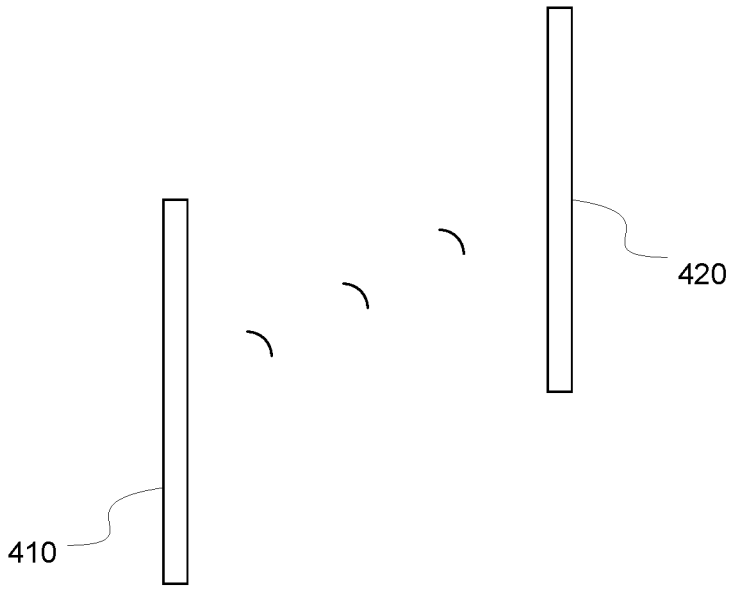
FIGS. 4A & 4B illustrate operation of a pair of monopole antennas, in accordance with the prior art.
Figure 4B:
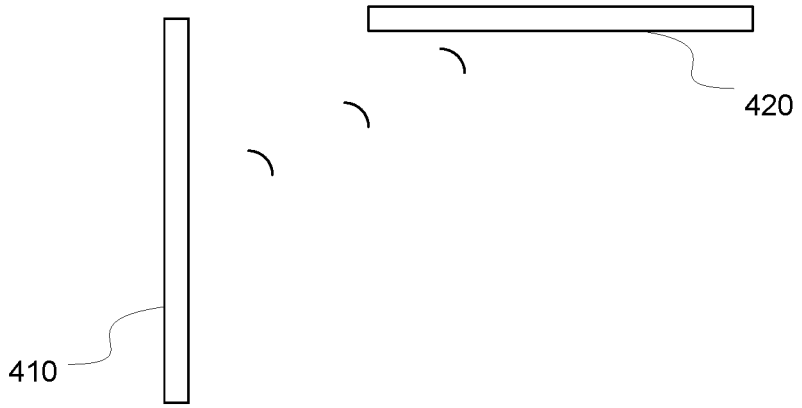

FIGS. 4A & 4B illustrate operation of a pair of monopole antennas, in accordance with the prior art. As shown in FIG. 4A, a first antenna 410 is aligned (i.e., coplanar) with a second antenna 420 and separated by a distance d. The first antenna 410 acts as a transmitter and the second antenna 420 acts as a receiver. A transmitter acts as a current source and drives electric charge to one end of the antenna 410, then followed by acting as a current sink draining electric charge from the end of the antenna 410. The current in the antenna 410 creates a magnetic field having a strength at any point proportional to the current and decreasing inversely proportional to the distance r from the antenna 410. The antenna 420 experiences an induced voltage due to the magnetic flux at the antenna 420, which drives a current in the antenna 420, which can be measured by a receiver coupled to the antenna 420.

The magnetic field at a point in the antenna 420 induced by a current in the antenna 410 will point perpendicularly to the antenna 420. The electric field is orthogonal to the magnetic field and, therefore, a current will be driven from one end of the antenna 420 to the other, where the current is opposite in direction to the current in the antenna 410. However, as shown in FIG. 4B, when the antenna 420 is orthogonal to the antenna 410 the magnetic field is aligned with the length of the antenna 420, which will induce eddy currents around the circumference of the conductor, but will not drive electric charge from one end of the antenna 420 to the other end of the antenna 420. Consequently, the signal cannot be measured by a receiver coupled to the antenna 420.

The description of the orientation of ideal antennas in FIG. 4 is theoretical, as actual EM waves will reflect off of other objects, and create a small signal in the antenna 420 even in a completely orthogonal orientation. However, the attenuation and phase shift of the signal, including attenuation due to multi-path interference and the longer distance of an indirect path, will result in a much weaker signal than the signal from a direct path between aligned antennas.

As one can infer from the description of the antennas 410 and 420, ideal transmission of a signal between a base transmitter and a receiver depends on the orientation between antennas. However, even if a base transmitter is coupled to a stationary antenna, the antenna arrays 100, 200, or 300 are intended to be embedded within a wearable device. Consequently, the orientation of the antenna array is likely to be constantly moving relative to an orientation of a corresponding antenna. Having two sets of antennas with orthogonal polarizations (i.e., orthogonal orientations) helps to ensure that the signal from at least one antenna in the antenna array is substantially aligned with the corresponding antenna in communication with the antenna array.

Figure 5:
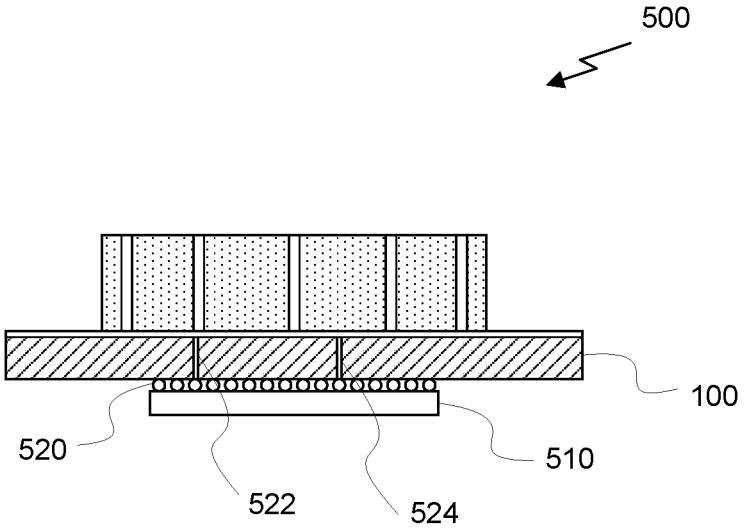
FIG. 5 illustrates a system including an antenna array, in accordance with one embodiment.

FIG. 5 illustrates a system 500 including an antenna array 100, in accordance with one embodiment. The system 500 includes an antenna array 100 coupled to an electronic component 510. The electrical component 510 may include one or more transceivers to drive one or more signals transmitted via the antenna array 100 or measure one or more signals received by the antenna array 100. In one embodiment, the electrical component 510 is mounted to the first side of the PCB substrate 160 via a ball grid array 520, although other types of surface mounting techniques are contemplated as being within the scope of the present disclosure. Vias, such as via 522 and via 524, may be used to route signals from the electrical component 510 to the antennas of the antenna array 100. Each via may pass through a void or hole in the ground plane 150 of the antenna array 100 to be connected to one or more antennas in the antenna array 100.

In one embodiment, the electrical component is a system-on-chip (SoC) mounted to a first side of the PCB substrate 160 opposite the ground plane 150. The SoC may include one or more transceivers for generating signals to drive the antennas in the antenna array 100. In one embodiment, the number of transceivers is as least two, a first transceiver connected to one or more of the antennas in the first plurality of antennas 110 and a second transceiver connected to one or more of the antennas in the second plurality of antennas 120. In another embodiment, the number of transceivers is equal to the number of antennas in the antenna array 100. For example, if there are 16 monopole antennas in the first plurality of antennas 110 and 16 loop antennas in the second plurality of antennas 120, then the SoC may include 32 transceivers coupled to the 32 independent antennas, each transceiver including a variable delay to apply a corresponding phase shift to the signal transmitted on the corresponding antenna. It will be appreciated that each transceiver may be configured to apply a gain shift and/or phase shift to the signal transmitted by the corresponding antenna(s).

Figure 6:
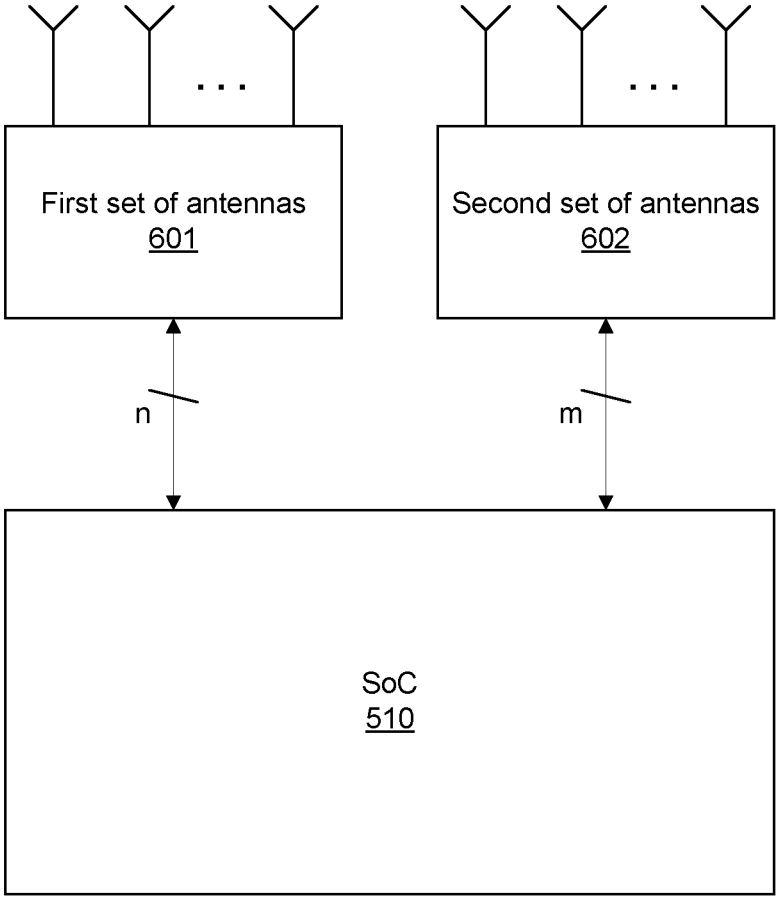
FIG. 6 is a schematic of the system of FIG. 5, in accordance with one embodiment.

FIG. 6 is a schematic of the system 500 of FIG. 5, in accordance with one embodiment. As shown in FIG. 6, the SoC 510 generates a plurality of signals that drive the current in the antennas of the antenna array 100. N signals are coupled to a first set of antennas 601, which may be the monopole antennas in the first plurality of antennas 110 of the antenna array 100. Similarly, M signals are coupled to a second set of antennas 602, which may be the loop antennas in the second plurality of antennas 120 of the antenna array 100. In one embodiment, M is equal to N, which also is equal to the number of antennas in both the first plurality of antennas 110 and the second plurality of antennas 120 in the antenna array 100. Having different signals for multiple antennas of a particular polarization enables the antenna array 100 to be configured to operate as a phased array that can steer the direction of the beam of the antenna array 100 in any one of 360 degrees.

Figure 7:
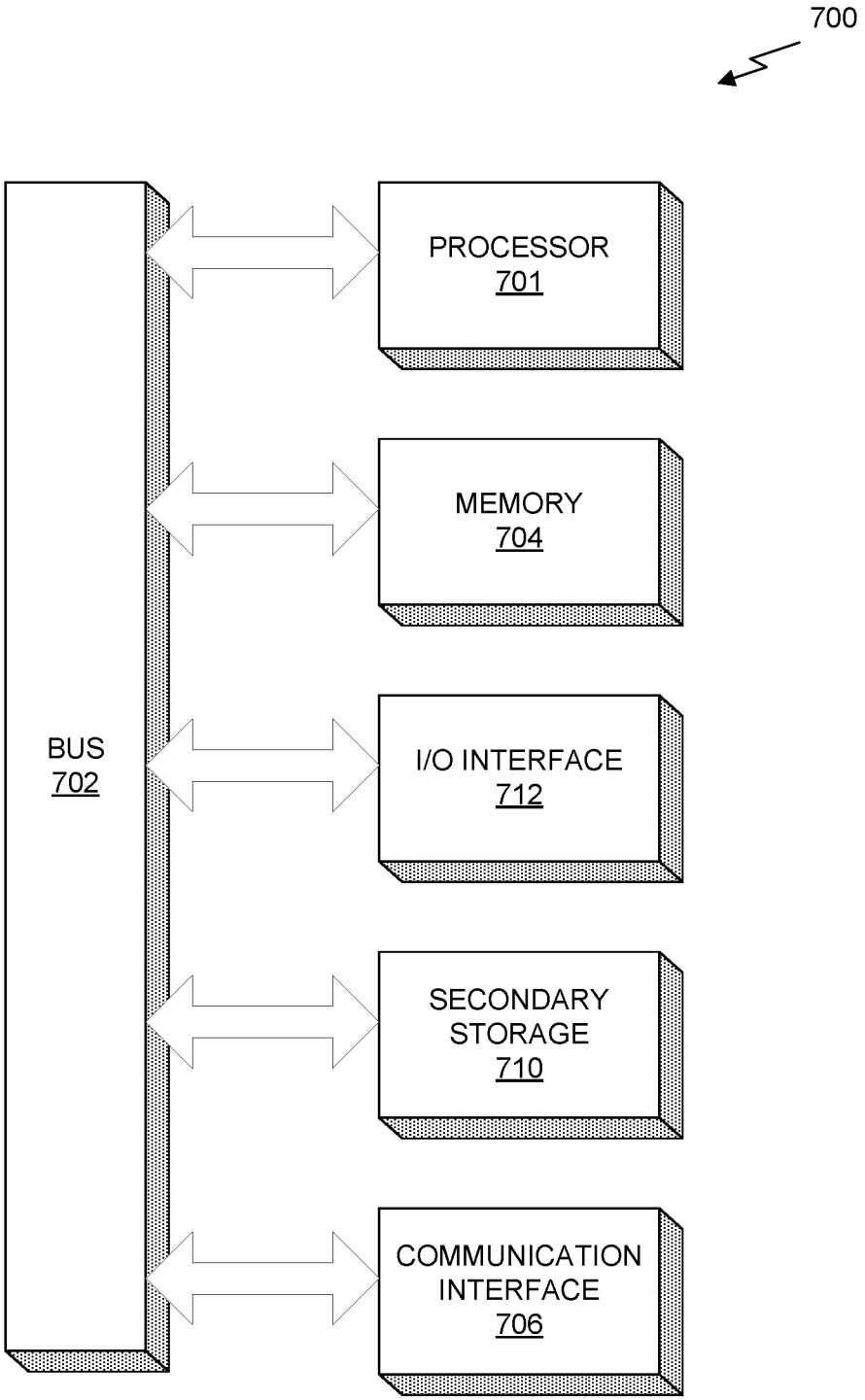
FIG. 7 illustrates an exemplary system in which the various architecture and/or functionality of the various previous embodiments may be implemented.

FIG. 7 illustrates an exemplary system 700 in which the various architecture and/or functionality of the various previous embodiments may be implemented. The antenna arrays 100, 200, and 300 may be coupled to the system to enable wireless communication, in operation with one or more radio transceivers. In one embodiment, the system 700 is implemented within the SoC 510. As shown, a system 700 is provided including at least one processor 701 that is connected to a communication bus 702. The communication bus 702 may be implemented using any suitable protocol, such as PCI (Peripheral Component Interconnect), PCI-Express, AGP (Accelerated Graphics Port), HyperTransport, or any other bus or point-to-point communication protocol (s). The system 700 also includes a memory 704. Control logic (software computer instructions) and data are stored in the memory 704 which may take the form of one or more forms of non-volatile memory as well as random access memory (RAM).

The system 700 also includes an input/output (I/O) interface 712 and a communication interface 706. User input may be received from the input devices 712, e.g., keyboard, mouse, touchpad, microphone, and the like. In one embodiment, the communication interface 706 may be coupled to a graphics processor (not shown) that includes a plurality of shader modules, a rasterization module, etc. Each of the foregoing modules may even be situated on a single semiconductor platform to form a graphics processing unit (GPU).

In the present description, a single semiconductor platform may refer to a sole unitary semiconductor-based integrated circuit or chip. It should be noted that the term single semiconductor platform may also refer to multi-chip modules with increased connectivity which simulate on-chip operation, and make substantial improvements over utilizing a conventional central processing unit (CPU) and bus implementation. Of course, the various modules may also be situated separately or in various combinations of semiconductor platforms per the desires of the user.

The system 700 may also include a secondary storage 710. The secondary storage 710 includes, for example, a hard disk drive and/or a removable storage drive, representing a floppy disk drive, a magnetic tape drive, a compact disk drive, digital versatile disk (DVD) drive, recording device, universal serial bus (USB) flash memory. The removable storage drive reads from and/or writes to a removable storage unit in a well-known manner.

Computer programs, or computer control logic algorithms, may be stored in the memory 704 and/or the secondary storage 710. Such computer programs, when executed, enable the system 700 to perform various functions. The memory 704, the storage 710, and/or any other storage are possible examples of computer-readable media.

In one embodiment, the architecture and/or functionality of the various previous figures may be implemented in the context of the processor 701, a graphics processor coupled to communication interface 706, an integrated circuit (not shown) that is capable of at least a portion of the capabilities of both the processor 701 and a graphics processor, a chipset (i.e., a group of integrated circuits designed to work and sold as a unit for performing related functions, etc.), and/or any other integrated circuit for that matter.

Still yet, the architecture and/or functionality of the various previous figures may be implemented in the context of a general computer system, a circuit board system, a game console system dedicated for entertainment purposes, an application-specific system, and/or any other desired system. For example, the system 700 may take the form of a desktop computer, laptop computer, server, workstation, game consoles, embedded system, and/or any other type of logic. Still yet, the system 700 may take the form of various other devices including, but not limited to a personal digital assistant (PDA) device, a mobile phone device, a television, etc.

Further, while not shown, the system 700 may be coupled to a network (e.g., a telecommunications network, local area network (LAN), wireless network, wide area network (WAN) such as the Internet, peer-to-peer network, cable network, or the like) for communication purposes.

It is noted that the techniques described herein, in an aspect, are embodied in executable instructions stored in a computer readable medium for use by or in connection with an instruction execution machine, apparatus, or device, such as a computer-based or processor-containing machine, apparatus, or device. It will be appreciated by those skilled in the art that for some embodiments, other types of computer readable media are included which may store data that is accessible by a computer, such as magnetic cassettes, flash memory cards, digital video disks, Bernoulli cartridges, random access memory (RAM), read-only memory (ROM), and the like.

As used here, a "computer-readable medium" includes one or more of any suitable media for storing the executable instructions of a computer program such that the instruction execution machine, system, apparatus, or device may read (or fetch) the instructions from the computer readable medium and execute the instructions for carrying out the described methods. Suitable storage formats include one or more of an electronic, magnetic, optical, and electromagnetic format. A non-exhaustive list of conventional exemplary computer readable medium includes: a portable computer diskette; a RAM; a ROM; an erasable programmable read only memory (EPROM or flash memory); optical storage devices, including a portable compact disc (CD), a portable digital video disc (DVD), a high definition DVD (HD-DVD™), a BLU-RAY disc; and the like.

It should be understood that the arrangement of components illustrated in the Figures described are exemplary and that other arrangements are possible. It should also be understood that the various system components (and means) defined by the claims, described below, and illustrated in the various block diagrams represent logical components in some systems configured according to the subject matter disclosed herein.

For example, one or more of these system components (and means) may be realized, in whole or in part, by at least some of the components illustrated in the arrangements illustrated in the described Figures. In addition, while at least one of these components are implemented at least partially as an electronic hardware component, and therefore constitutes a machine, the other components may be implemented in software that when included in an execution environment constitutes a machine, hardware, or a combination of software and hardware.

More particularly, at least one component defined by the claims is implemented at least partially as an electronic hardware component, such as an instruction execution machine (e.g., a processor-based or processor-containing machine) and/or as specialized circuits or circuitry (e.g., discreet logic gates interconnected to perform a specialized function). Other components may be implemented in software, hardware, or a combination of software and hardware. Moreover, some or all of these other components may be combined, some may be omitted altogether, and additional components may be added while still achieving the functionality described herein. Thus, the subject matter described herein may be embodied in many different variations, and all such variations are contemplated to be within the scope of what is claimed.

In the description above, the subject matter is described with reference to acts and symbolic representations of operations that are performed by one or more devices, unless indicated otherwise. As such, it will be understood that such acts and operations, which are at times referred to as being computer-executed, include the manipulation by the processor of data in a structured form. This manipulation transforms the data or maintains it at locations in the memory system of the computer, which reconfigures or otherwise alters the operation of the device in a manner well understood by those skilled in the art. The data is maintained at physical locations of the memory as data structures that have particular properties defined by the format of the data. However, while the subject matter is being described in the foregoing context, it is not meant to be limiting as those of skill in the art will appreciate that various acts and operations described hereinafter may also be implemented in hardware.

To facilitate an understanding of the subject matter described herein, many aspects are described in terms of sequences of actions. At least one of these aspects defined by the claims is performed by an electronic hardware component. For example, it will be recognized that the various actions may be performed by specialized circuits or circuitry, by program instructions being executed by one or more processors, or by a combination of both. The description herein of any sequence of actions is not intended to imply that the specific order described for performing that sequence must be followed. All methods described herein may be performed in any suitable order unless otherwise indicated herein or otherwise clearly contradicted by context.

The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

The embodiments described herein include the one or more modes known to the inventor for carrying out the claimed subject matter. It is to be appreciated that variations of those embodiments will become apparent to those of ordinary skill in the art upon reading the foregoing description. The inventor expects skilled artisans to employ such variations as appropriate, and the inventor intends for the claimed subject matter to be practiced otherwise than as specifically described herein. Accordingly, this claimed subject matter includes all modifications and equivalents of the subject matter recited in the claims appended hereto as permitted by applicable law. Moreover, any combination of the above-described elements in all possible variations thereof is encompassed unless otherwise indicated herein or otherwise clearly contradicted by context.

What is claimed is:

1. An antenna array, comprising:

a first plurality of antennas integrated with an antenna substrate, wherein each antenna in the first plurality of antennas is disposed perpendicular to a ground plane; and a second plurality of antennas integrated with the antenna substrate, wherein each antenna in the second plurality of antennas is disposed parallel to the ground plane, wherein the antenna array is mounted in a wearable device such that the ground plane is configured to be disposed between a body of a user and the antenna array.

2. The antenna array of claim 1, wherein each antenna in the first plurality of antennas is a monopole antenna.

3. The antenna array of claim 1, wherein the antenna substrate has a cylindrical shape, and wherein the first plurality of antennas and the second plurality of antennas are arranged in a circular pattern proximate an edge at a perimeter of the antenna substrate.

4. The antenna array of claim 3, wherein each antenna in the second plurality of antennas is a loop antenna disposed on a plane of the antenna substrate that is parallel to the ground plane.

5. The antenna array of claim 4, wherein a distance between the plane of the antenna substrate and the ground plane is based on a wavelength corresponding to an operating frequency of the antenna array and material characteristics of the antenna substrate.

6. The antenna array of claim 5, wherein the operating frequency of the antenna array is within a 57 GHz to 66 GHz band range.

7. The antenna array of claim 2, wherein each antenna in the second plurality of antennas is a dipole antenna.

8. The antenna array of claim 1, further comprising a ground wall that comprises a plurality of vias and printed metal layers integrated with the antenna substrate.

9. The antenna array of claim 1, wherein the first plurality of antennas and the second plurality of antennas are configured to operate as a phased array.

10. A system that includes an antenna array, comprising:

a printed circuit board (PCB) substrate;

a system-on-chip (SoC) mounted to a first side of the PCB substrate; and an antenna array mounted to a second side of the PCB substrate opposite the first side of the PCB substrate, wherein the antenna array includes:

a first plurality of antennas integrated with an antenna substrate, wherein each antenna in the first plurality of antennas is disposed perpendicular to a ground plane; and a second plurality of antennas integrated with the antenna substrate, wherein each antenna in the second plurality of antennas is disposed parallel to the ground plane.

11. The system of claim 10, wherein each antenna in the first plurality of antennas is a monopole antenna.

12. The system of claim 10, wherein the antenna substrate has a cylindrical shape, and wherein the first plurality of antennas and the second plurality of antennas are arranged in a circular pattern proximate an edge at a perimeter of the antenna substrate.

13. The system of claim 12, wherein each antenna in the second plurality of antennas is a loop antenna disposed on a plane of the antenna substrate that is parallel to the ground plane.

14. The system of claim 13, wherein a distance between the plane of the antenna substrate and the ground plane is based on a wavelength corresponding to an operating frequency of the antenna array and material characteristics of the antenna substrate.

15. The system of claim 14, wherein the operating frequency of the antenna array is within a 57 GHz to 66 GHz band range.

16. The system of claim 11, wherein each antenna in the second plurality of antennas is a dipole antenna.

17. The system of claim 10, wherein the antenna array further includes a ground wall that comprises a plurality of vias and printed metal layers integrated with the antenna substrate.

18. The system of claim 10, wherein the first set of antennas and the second set of antennas are configured to operate as a phased array.

19. The system of claim 10, wherein the antenna array is mounted in a wearable device such that a ground plane is disposed between a body of a user and the antenna array.

20. A wearable communication device, comprising:

a system-on-chip (SoC);

a ground plane; and an antenna array mounted to a first side of the ground plane such that the ground plane is disposed between the antenna array and a person wearing the wearable communication device, wherein the antenna array includes:

a first plurality of antennas, wherein each antenna in the first plurality of antennas is disposed perpendicular to the ground plane; and a second plurality of antennas, wherein each antenna in the second plurality of antennas is disposed parallel to the ground plane.

21. The wearable communication device of claim 20, wherein each antenna of the first plurality of antennas is a monopole antenna.

22. The wearable communication device of claim 21, wherein each antenna of the second plurality of antennas is a loop antenna.

23. The wearable communication device of claim 21, wherein each antenna of the second plurality of antennas is a dipole antenna.

24. The wearable communication device of claim 20, further comprising an antenna substrate having a plane disposed substantially parallel to the ground plane, wherein a distance between the plane of the antenna substrate and the ground plane is based on a wavelength corresponding to an operating frequency of the antenna array and material characteristics of the antenna substrate.

25. The wearable communication device of claim 24, wherein the operating frequency of the antenna array is within a 57 GHz to 66 GHz band range.

26. The wearable communication device of claim 24, wherein the antenna array further includes a ground wall that comprises a plurality of vias and printed metal layers formed in the antenna substrate configured to connect each of the first and second plurality of antennas to the SoC to communicate communication signals.

27. The wearable communication device of claim 20, wherein the first plurality of antennas and the second plurality of antennas are configured to operate as a phased array.

* * * * *